US007488271B2

(12) United States Patent
Inoue et al.

(10) Patent No.: US 7,488,271 B2
(45) Date of Patent: Feb. 10, 2009

(54) CONTROL METHOD OF MAGNET TYPE FAN CLUTCH

(75) Inventors: Hiroshi Inoue, Numazu (JP); Ken Shiozaki, Susono (JP)

(73) Assignee: Usui Kokusai Sangyo Kaisha Limited (JP)

( * ) Notice: Subject to any disclaimer, the term of this patent is extended or adjusted under 35 U.S.C. 154(b) by 255 days.

(21) Appl. No.: 11/295,881

(22) Filed: Dec. 7, 2005

(65) Prior Publication Data

US 2006/0124424 A1 Jun. 15, 2006

(30) Foreign Application Priority Data

Dec. 10, 2004 (JP) ..... 2004-358817

(51) Int. Cl.
*F16D 27/01* (2006.01)
*F01P 7/04* (2006.01)

(52) U.S. Cl. ..... 477/175; 192/48.2; 192/84.31; 477/179

(58) Field of Classification Search ..... None
See application file for complete search history.

(56) References Cited

U.S. PATENT DOCUMENTS

| | | | |
|---|---|---|---|
| 2,879,755 | A | 3/1959 | Weir |
| 2,988,188 | A | 6/1961 | Tauschek |
| 3,059,745 | A | 10/1962 | Tauschek |
| 3,217,849 | A | 11/1965 | Weir |
| 3,259,221 | A | 7/1966 | Godfrey |
| 3,272,188 | A | 9/1966 | Sabat |
| 3,430,743 | A | 3/1969 | Fujita et al. |
| 3,463,282 | A | 8/1969 | Fujita et al. |
| 3,642,105 | A | 2/1972 | Kikuchi |
| 3,727,354 | A | 4/1973 | La Flame |
| 3,840,101 | A | 10/1974 | Peter et al. |
| 3,856,122 | A | 12/1974 | Leichliter |
| 3,893,555 | A | 7/1975 | Elmer |
| 3,964,582 | A | 6/1976 | Mitchell |
| 4,238,016 | A | 12/1980 | Yoshida et al. |
| 4,281,750 | A | 8/1981 | Clancey |
| 4,403,684 | A | 9/1983 | Haeck |
| 4,505,367 | A | 3/1985 | Martin |
| 4,629,046 | A | 12/1986 | Martin |
| 4,665,694 | A | 5/1987 | Brunken |
| 4,667,791 | A | 5/1987 | Martin et al. |

(Continued)

FOREIGN PATENT DOCUMENTS

| | | |
|---|---|---|
| JP | 54-25581 | 8/1979 |

(Continued)

*Primary Examiner*—Rodney H Bonck
(74) *Attorney, Agent, or Firm*—Gerald E. Hespos; Anthony J. Casella

(57) ABSTRACT

A control method of a magnet type fan clutch is provided to improve engine performance, fuel economy, engine life, and vehicle acceleration and to reduce fan noise, and optimize fan horsepower. The magnet type fan clutch has a magnet coupling combined with an electromagnetic clutch. The method includes turning the electromagnetic clutch ON and OFF on the basis of cooling fluid temperature, engine oil temperature, transmission oil temperature, vehicle speed, engine rotation rate, accelerator opening, compressor pressure of an air conditioner, an On or Off signal of the air condition, a fuel injection indication amount, a clutch activation lower limit temperature and its lower temperature, and an engine rotation rate set value to control the fan rotation.

4 Claims, 5 Drawing Sheets

U.S. PATENT DOCUMENTS

| | | | | |
|---|---|---|---|---|
| 4,685,549 | A | 8/1987 | Brunken et al. | |
| 4,699,258 | A | 10/1987 | Johnston et al. | |
| 4,796,571 | A | 1/1989 | Ono et al. | |
| 4,846,331 | A | 7/1989 | Ono | |
| 4,850,465 | A | 7/1989 | Ono | |
| 4,903,643 | A | 2/1990 | Takikawa et al. | |
| 4,930,458 | A | 6/1990 | Takikawa et al. | |
| 5,004,085 | A | 4/1991 | Taureg | |
| 5,018,612 | A | 5/1991 | Takikawa et al. | |
| 5,060,774 | A | 10/1991 | Takikawa et al. | |
| 5,090,533 | A | 2/1992 | Inoue | |
| 5,101,949 | A | 4/1992 | Takikawa et al. | |
| 5,109,965 | A | 5/1992 | Inoue | |
| 5,119,920 | A | 6/1992 | Inoue | |
| 5,125,491 | A | 6/1992 | Takikawa et al. | |
| 5,139,125 | A | 8/1992 | Takikawa et al. | |
| 5,224,446 | A | 7/1993 | Okita et al. | |
| 5,232,074 | A | 8/1993 | Watanabe | |
| 5,452,782 | A | 9/1995 | Inoue | |
| 5,501,183 | A | 3/1996 | Takayama | |
| 5,575,368 | A | 11/1996 | Kikuchi et al. | |
| 5,794,749 | A | 8/1998 | Ryuu | |
| 5,881,857 | A | 3/1999 | Ryuu | |
| 6,125,981 | A | 10/2000 | Ito et al. | |
| 6,247,567 | B1 | 6/2001 | Watanabe | |
| 6,550,596 | B2 | 4/2003 | Shiozaki et al. | |
| 6,634,476 | B2 * | 10/2003 | Inoue et al. | 192/48.2 |
| 6,772,714 | B2 * | 8/2004 | Laird et al. | 123/41.12 |
| 6,807,926 | B2 * | 10/2004 | Shiozaki et al. | 123/41.12 |
| 6,811,009 | B2 | 11/2004 | Inoue et al. | |
| 6,915,888 | B2 | 7/2005 | Shiozaki et al. | |

FOREIGN PATENT DOCUMENTS

| | | |
|---|---|---|
| JP | 55-76226 | 6/1980 |
| JP | 57-1829 | 1/1982 |
| JP | 57-167533 | 10/1982 |
| JP | 57-179431 | 11/1982 |
| JP | 59-27452 | 7/1984 |
| JP | 62-124330 | 6/1987 |
| JP | 62-194038 | 8/1987 |
| JP | 63-182332 | 11/1988 |
| JP | 4-258530 | 9/1992 |
| JP | 7-68079 | 3/1995 |
| JP | 9-119455 | 5/1997 |
| JP | 9-137835 | 5/1997 |
| JP | 2003-156072 | 5/2003 |

* cited by examiner

CONTROL METHOD OF MAGNET TYPE FAN CLUTCH

BACKGROUND OF THE INVENTION

1. Field of the Invention

The present invention relates to a control method of a magnet type fan clutch which controls rotation of a cooling fan to be mainly applied to an internal combustion engine for vehicles, and more specifically to a control method of a magnet type fan clutch, which is configured in such a manner that a magnet coupling and an electromagnetic clutch are integrated with each other and the magnet coupling is controlled so as to be turned on and off by the electromagnetic clutch.

2. Description of Related Art

As a magnet type fan clutch which controls rotation of a cooling fan to be applied to an internal combustion engine for vehicles, in JP-A-9-119455, a viscous fluid joint which transmits an output drive torque to a radiator cooling fan by a driving torque from an engine for vehicle and its control method are disclosed. This viscous fluid joint takes a system for fluctuating an oil supply amount when a valve is opened or closed due to transformation of a bimetal responding to a temperature of a radiator passing wind and changing a rotation of a fan. To explain it more in detail, an object of this system is to prevent a fan noise and a heat of slip at a low idle condition when a vehicle is stopping and this system is constituted by steps of detecting a rotational rate of a vehicle engine, comparing its actual measurement value with a limited value that has been set in advance, detecting a rotational rate of a radiator cooling fan when the rotational rate of the engine is lower than the limited value, comparing a fan rate with a fan rate limited value that has been decided in advance, and correcting an input signal in order to move a valve member to a closed position when the fan rate is higher than the limited value.

However, according to the control method of the viscous fluid joint of a system that the valve is opened or closed by transformation of the bimetal reacting to a temperature of a radiator passing wind to fluctuate the oil supply amount and change the fan rotation, it is not possible to make the temperature of an engine cooling fluid deciding an engine cooling performance into a direct control object, so that this involves disadvantages such that a loss of horsepower is generated due to an unnecessary fan rotation, a lower fuel economy is caused, a good fan rotation of cooling of a condenser of an air condition (A/C) cannot be maintained, and a fan noise due to the unnecessary fan rotation at an acceleration time cannot be reduced or the like.

Therefore, in order to solve the disadvantage of a cooling control method depending on the above-described radiator passing wind temperature, the present applicant proposed an external control system fan clutch capable of improving an engine performance and a fuel economy, improving a cooling performance of an air conditioner (A/C) condenser, and reducing a fan noise by externally controlling the fan clutch in advance (refer to U.S. Pat. Nos. 6,634,476 B2, 6,811,009 B2, JP-A-2003-156072 or the like). This external control system fan clutch is configured in such a manner that the magnet coupling and the electromagnetic clutch are integrated with each other, the fan is attached to the magnet coupling side, and the magnet coupling is controlled so as to be turned on and off by the electromagnetic clutch. Specifically, for example, the external control system fan clutch is configured by a rotatable electromagnetic clutch comprising a clutch rotor that is supported by a driving shaft and an excitation coil supported by the exterior is incorporated therein and an armature attached to a circular disk rotatably supported by the driving shaft via a bearing device; and a magnet coupling, which is rotatably supported by the driving shaft via the bearing device, and has a hysteresis material or a conductor that is attached to the circular disk so as to be opposed to a permanent magnet rotator to which outer circumference a fan is attached and the permanent magnet at a slight gap, and the permanent magnet rotator and the circular disk are rotated integrally or relatively due to the action between the permanent magnet and the hysteresis material or the conductor. The magnet coupling is ON and OFF controlled by the electromagnetic clutch.

The magnet type fan clutch of such a configuration can control a magnet coupling, namely, a fan rotation by ON and OFF controlling the electromagnetic clutch. In addition, the electromagnetic clutch is ON and OFF controlled in conjunction with a temperature of cooling water, throttle opening, an engine rotation rate, an accelerator (throttle) opening and a switch of the air conditioner, so that the magnet type fan clutch has an excellent advantage such that it can stably control the fan rotation with a high degree of accuracy.

However, according to a binary control with an engine cooling fluid temperature used as a control parameter, when the engine cooling fluid temperature is near a set threshold, ON and OFF of the clutch is frequently caused and a loss of a horsepower, a noise, and wear of a friction plate of the clutch or the like become problems. For example, with respect to a relation between fan rotation rate and horsepower consumption when the clutch is changed temporarily from OFF to ON, inertia horsepower of the fan and the fan clutch (an inertia moment the fan rotation acceleration) are generated several times upon a stationary fan.

SUMMARY OF THE INVENTION

An object of the present invention is to further improve an engine performance, a fuel economy, an engine life, and a vehicle acceleration performance or the like and to further reduce the noise of this kind of magnet type fan clutch that was proposed in advance by the present applicant; and to propose a control method of the magnet type fan clutch capable of reducing loss of a fan horsepower, reducing a noise, and making a friction plate life of the clutch longer by controlling the fan clutch to reduce the actuation frequency of the clutch.

A control method of a magnet type fan clutch according to the present invention is a control method of a magnet type fan clutch, wherein a magnet coupling is combined with an electromagnetic clutch; a fan is attached to the magnet coupling side; and the magnet coupling is ON and OFF—controlled by the electromagnetic clutch; the method including turning ON and OFF the electromagnetic clutch on the basis of a radiator cooling fluid temperature, an engine oil temperature, a transmission oil temperature, a vehicle speed, an engine rotation rate, an accelerator (throttle) opening, a compressor pressure of an air conditioner and an On or Off signal of the air conditioner, a fuel injection indication amount, a clutch activation lower limit temperature and its lower temperature, and an engine rotation rate set value to control the fan rotation.

In addition, according to this control method, the electromagnetic clutch is turned ON and OFF so as to control the fan rotation with the optimum temperature range of the radiator cooling fluid and or the engine oil defined as a boundary, or the engine rotation acceleration or an accelerator opening acceleration upon acceleration of a vehicle is detected; and when this detected value exceeds a predetermined value, the electromagnetic clutch is turned OFF so as to control the fan rotation, or when continuously turning ON the electromagnetic clutch, the electromagnetic clutch can be continuously turned ON after repeating ON and OFF of this clutch.

According to the method of the present invention, in a magnet type fan clutch, wherein a magnet coupling is combined with an electromagnetic clutch; a fan is attached to the magnet coupling side; and the magnet coupling is ON and OFF-controlled by the electromagnetic clutch; by controlling ON timing of the electromagnetic clutch and connection of the clutch using a radiator cooling fluid temperature, an engine oil temperature, a transmission oil temperature, a vehicle speed, an engine rotation rate, an accelerator (throttle) opening, a compressor pressure of an air conditioner and an On or Off signal of the air conditioner, an engine rotation acceleration, an accelerator opening acceleration, and a fuel injection indication amount as a control parameter, it is possible to improve a fuel economy, make the electromagnetic clutch life longer, save capacity of the electromagnetic clutch (weight saving and reduction of a cost), improve the engine performance and the acceleration performance of the vehicle, make the engine life longer, reduce the fan noise due to the tangled rotation, reduce the fan noise, further, clean an exhaustion gas. In addition, when the vehicle is moving down on a slope only by inertia (without the fuel injection), by rotating the fan while turning ON the clutch without relation to a condition such as an engine cooling fluid temperature or the like, it is possible to use the fan rotation horsepower as a braking power of the vehicle.

BRIEF DESCRIPTION OF THE DRAWINGS

FIGS. 6A and 6B show the optimum control method of the fan clutch when the engine rotation rate (ES) exceeds an engine rotation rate set value (N) or the engine rotation rate (ES) is below the engine rotation rate set value (N) according to the example of control of the fan clutch by the control system shown in FIG. 2 according to the example of control of the fan clutch by the control system shown in FIG. 2, wherein FIG. 6A shows the case of ES<N and FIG. 6B shows the case of ES>N, respectively.

DESCRIPTION OF PREFERRED EMBODIMENTS

Figure 1:
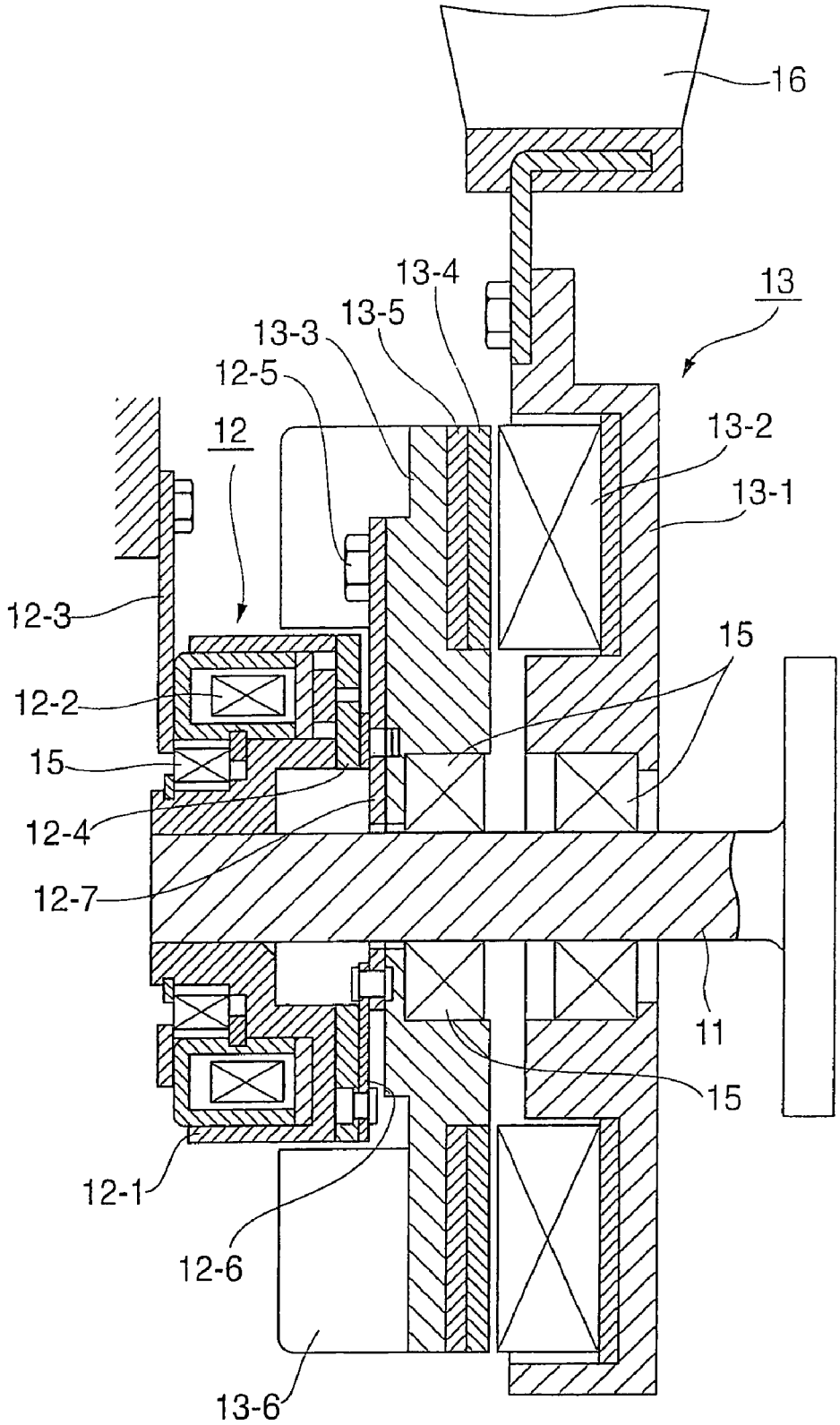
FIG. 1 is a longitudinal sectional view showing an embodiment of a magnet type fan clutch according to the present invention.
Figure 2:
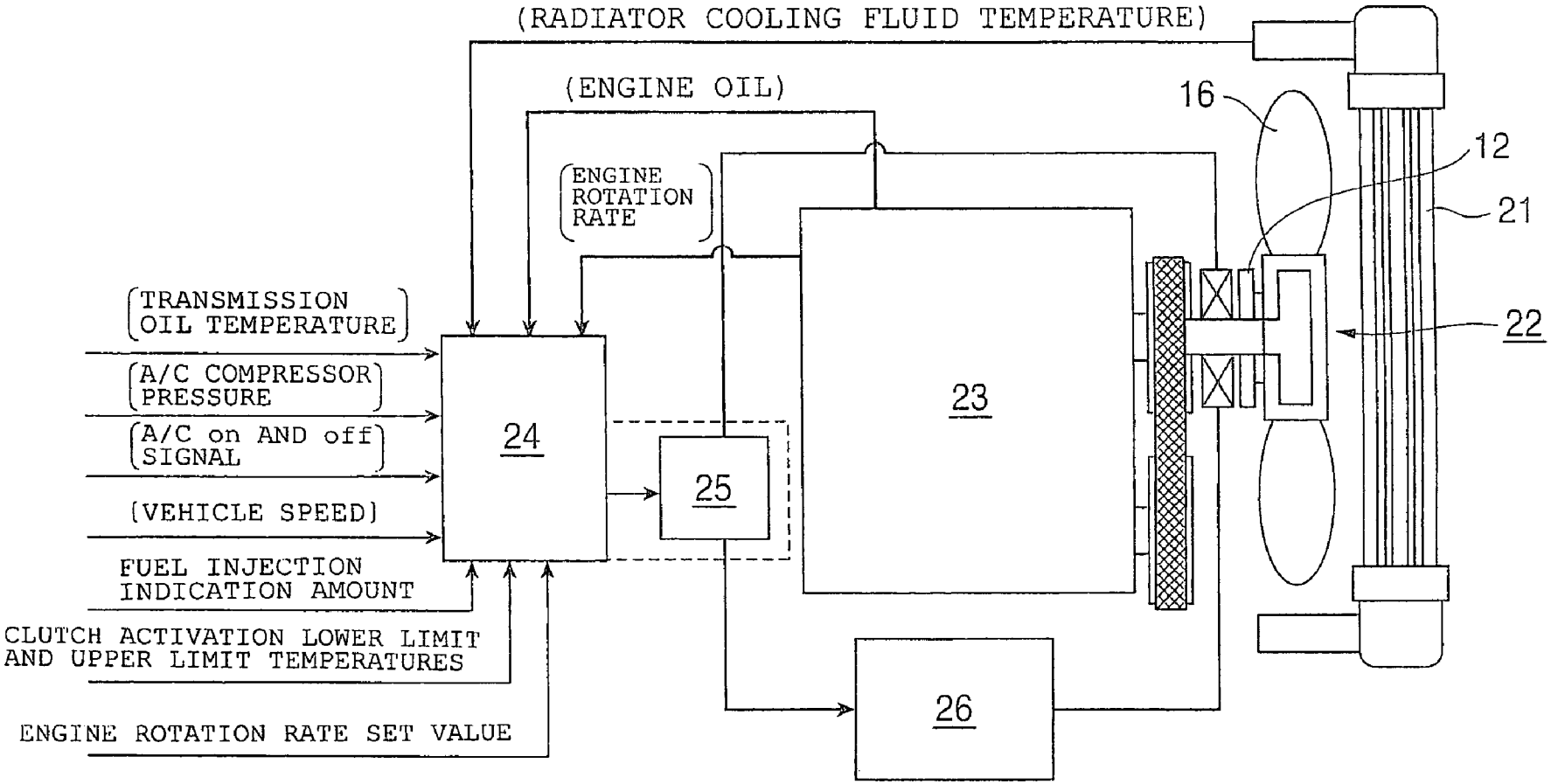
FIG. 2 is a schematic diagram showing an example of the entire structure of a control system for putting a control method of the magnet type fan clutch shown in FIG. 1 in execution.
Figure 3:
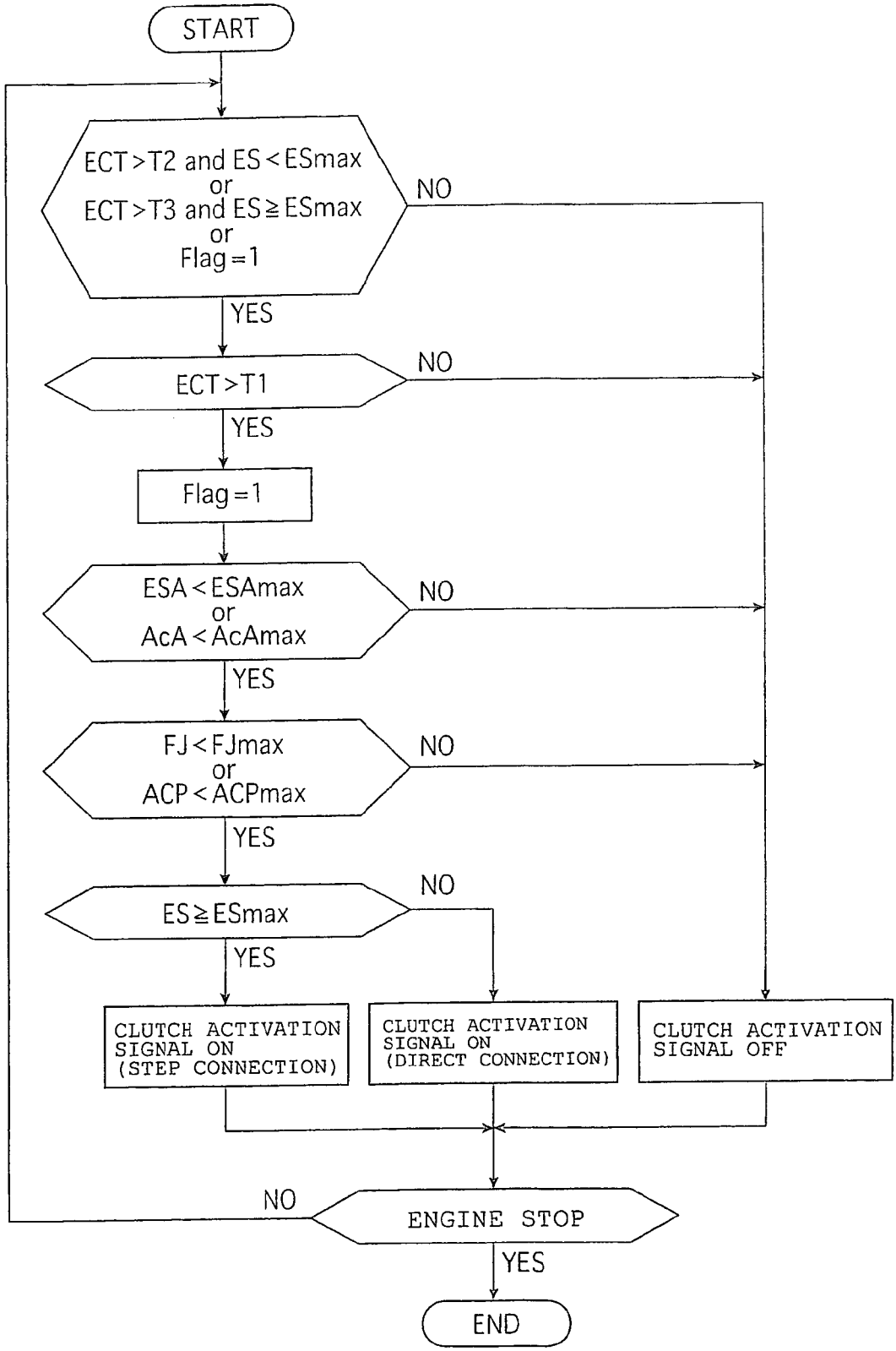
FIG. 3 is a flow chart showing an embodiment of the control method of the magnet type fan clutch by the control system shown in FIG. 2.

FIG. 1 is a longitudinal sectional view showing an embodiment of a magnet type fan clutch according to the present invention, FIG. 2 is a schematic diagram showing an example of the entire structure of a control system for putting a control method of the magnet type fan clutch shown in FIG. 1 in execution, FIG. 3 is a flow chart showing an embodiment of the control method of this magnet type fan clutch, and FIGS. 4 to 7 show a fan rotation control example of this magnet type fan clutch.

The magnet type fan clutch shown in FIG. 1 is configured by an electromagnetic clutch 12 arranged in one piece of a driving shaft 11 and a magnet coupling 13. The electromagnetic clutch 12 is configured by a clutch rotor 12-1 that is integrally supported by an end portion of the driving shaft 11 and an excitation coil 12-2 that is fit in this clutch rotor 12-1 via a bearing device 15 rotatably with each other and is fixed to the exterior via a bracket 12-3, and an armature 12-4 that is movably in back and front at the excitation coil 12-2 of a circular disk 13-3 rotatably supported by the driving shaft 11 via the bearing device 15. The armature 12-4 is externally fit in the driving shaft 11 and its one end side is attached to the side of the clutch rotor 12-1 via a spring 12-6 of which one end is fixed to a stay 12-7 that is fixed to the circular disk 13-3 by a bolt 12-5. In addition, the magnet coupling 13 is configured in such a manner that a fan 16 is attached to a permanent magnet rotator 13-1 rotatably supported to the driving side opposite to the electromagnetic clutch 12 of the driving shaft 11 via the bearing device 15, a conductor 13-4 opposed to a permanent magnet 13-2 mounted on the permanent magnet rotator 13-1 at a slight gap is attached to the circular disk 13-3 via a core 13-5, and the circular disk 13-3 is integrally rotated or is relatively rotated with respect to the permanent magnet rotator 13-1 due to the attracting action acting between the permanent magnet 13-2 and the conductor 13-4. A reference numeral 13-6 denotes a heat release fin.

In the magnet type fan clutch having the configuration shown in FIG. 1, if the electromagnetic clutch 12 is turned ON with the driving shaft 11 rotating, the armature 12-4 held by the circular disk 13-3 at the side of the magnet coupling 13 is attracted by the excitation coil 12-2 provided within the clutch rotor 12-1 rotating integrally with the driving shaft 11 to be absorbed to the clutch rotor 12-1, so that this clutch rotor 12-1, the armature 12-4, and the circular disk 13-3 are integrally rotated. If this circular disk 13-3 is rotated, the permanent magnet rotator 13-1 starts to rotate due to the attracting action acting between the conductor 13-4 mounted on this circular disk 13-3 and the permanent magnet 13-2 of the permanent magnet rotator 13-1 and a fan 16 starts to rotate. In this time, since the magnet coupling 13 becomes a cushion start, a load when the electromagnetic clutch 12 is turned ON is small and the fan noise can be remarkably reduced. In addition, if the electromagnetic clutch 12 is turned OFF, the rotation rate of the circular disk 13-3 is largely decreased or stops when the armature 12-4 is separated from the clutch rotor 12-1 due to a spring force of the spring 12-6, and then, the rotation rate of the fan 16 is largely decreased or stops. In other words, by turning ON and OFF the electromagnetic clutch 12, it is possible to control the rotation of the fan 16.

Next, the above-described control system for effecting the magnet type fan clutch will be described on the basis of FIG. 2.

In other words, in this control system, introducing a cooling fluid temperature of a radiator 21, an engine oil, a transmission oil temperature, a vehicle speed of an engine oil 23, and a rotation rate of the engine 23, a compressor pressure of an air condition and an ON or OFF signal, an accelerator (throttle) opening, a fuel injection indication amount, a clutch activation lower limit temperature, the clutch activation upper limit temperature, and the engine rotation rate set value of the air conditioner in a main calculation controller 24; judging the optimum temperature range of the radiator cooling fluid and the engine oil and the engine rotation acceleration range by the main calculation controller; and transmitting a signal necessary to fluctuate the fan rotation from the main calculation controller 24 into a relay box 25; then, switching is carried out; a power source is supplied to the electromagnetic clutch 12 of the magnet type fan clutch 22; this electromagnetic clutch is controlled so as to be turned ON and OFF; and the optimum control of the radiator cooling fluid temperature and the engine oil temperature, the optimum control of the fan clutch upon acceleration of the vehicle, and the ON and OFF activation control of the fan clutch are carried out. In the drawing, a reference numeral 26 denotes a battery.

In the meantime, it is obvious that the magnet type fan clutch 22 is not limited to the clutch shown in FIG. 1.

Subsequently, an embodiment of the control method of the control system according to the present invention shown in FIG. 2 will be described on the basis of FIG. 3.

FIG. 3 illustrates a control method of a fan clutch due to a radiator cooling fluid temperature (an engine cooling fluid temperature) (ECT), a clutch activation lower limit temperature T1, a clutch activation temperature T2, a clutch activation upper limit temperature T3, an engine rotation rate (ES), an engine rotation rate upper set value (ESmax), an engine rotation acceleration (ESA), an engine rotation acceleration upper limit set value (ESAmax), an accelerator opening acceleration (AcA), an accelerator opening acceleration upper limit set value (AcAmax), a fuel injection indication amount (FJ), a fuel injection indication amount upper limit set value (FJmax), an A/C compressor pressure (ACP), and an A/C compressor pressure upper limit set value (ACPmax) while the vehicle is moving. On the basis of the data of ECT, ES, ESA, AcA, FJ, and ACP introduced in the main calculation controller 24 while the vehicle is moving, in the case that each condition such as, at first, ECT>T2 and ES<ESAmax or ECT>T3 and ES≧ESmax, ECT>T1, ESA<ESAmax or AcA<AcAmax FJ<FJmax or ACP<ACPmax, ES≧ESmax is satisfied, the electromagnetic clutch 12 is turned ON (step connection), in the case that the above-described each condition is not satisfied, the electromagnetic clutch 12 is turned OFF, and in the case that the condition of ES≧ESmax is not satisfied, the electromagnetic clutch 12 is turned ON (direct connection).

Figure 4:
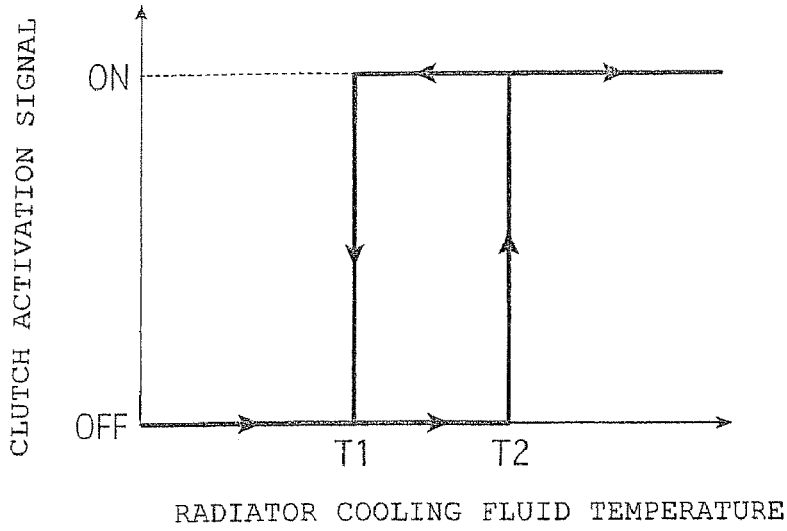
FIG. 4 is a diagram showing the other embodiment of the control method of the fan clutch shown in FIG. 3.

FIG. 4 illustrates a method for ON/OFF controlling a clutch by using the above-described radiator cooling fluid temperature (ECT) as a control parameter of a fan clutch and in the case that the radiator cooling fluid temperature (ECT) exceeds a clutch activation upper limit temperature T2, a clutch activation signal is changed from OFF to ON. On the other hand, when the electromagnetic clutch 12 that is ON-activated is below a clutch activation lower limit temperature (T1), the electromagnetic clutch 12 is OFF-activated. In the case of this control method, in order to make a time interval between ON and OFF of the electromagnetic clutch longer, a threshold is divided by a temperature rising and a temperature dropping of the radiator cooling fluid temperature (ECT) to perform ON/OFF control, so that it is not necessary to repeat ON/OFF of the electromagnetic clutch 12 during a short time and the life of the electromagnetic clutch is made longer.

Figure 5:
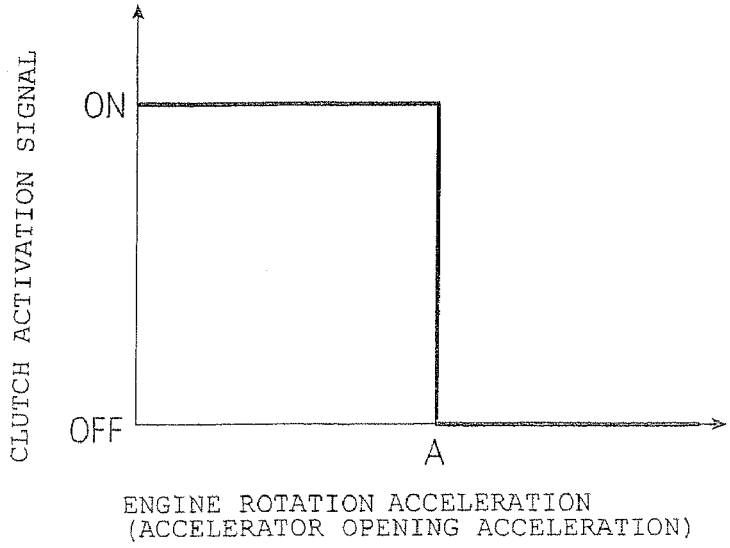
FIG. 5 shows a control method of a fan clutch by using an engine rotation rate or an accelerator opening acceleration according to the example of control of the fan clutch by the control system shown in FIG. 2.

FIG. 5 illustrates a method for ON/OFF controlling a clutch by using the engine rotation acceleration (the accelerator opening acceleration) as a control parameter of a fan clutch and on the basis of the data of the vehicle speed, the engine rotation rate, and the accelerator opening introduced in the main calculation controller 24, detecting the engine rotation acceleration or the accelerator opening acceleration, and then, when that detected value exceeds a value not less than a predetermined value A, the electromagnetic clutch 12 is compulsorily turned OFF for a predetermined time. Thereby, it is possible to temporarily reduce the fan rotation horsepower loss and to improve the acceleration performance of the vehicle.

Figure 6A:
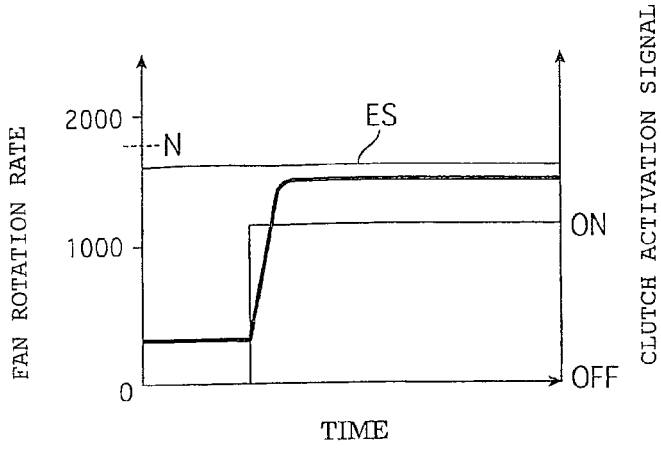
Figure 6B:
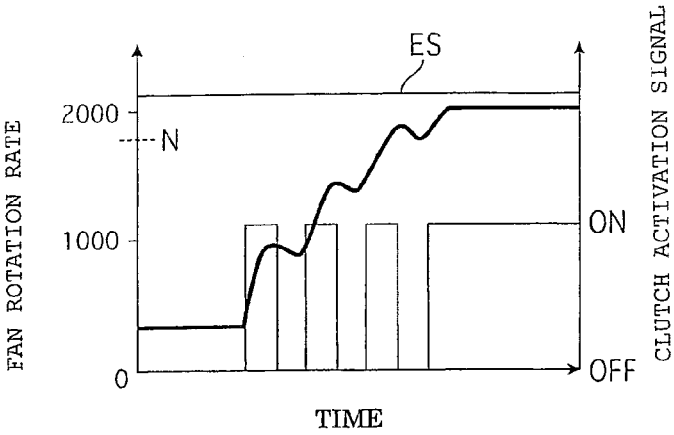

FIGS. 6A and 6B illustrate the optimum control method of a fan clutch when the engine rotation rate (ES) exceeds an engine rotation rate set value (N) or is below it. FIG. 6A shows the case of ES<N and FIG. 6B shows the case of ES>N, respectively. In other words, when the engine rotation rate (ES) is below the engine rotation rate set value (N), as shown in FIG. 6A, the electromagnetic clutch 12 is ON-activated instantly, however, in the case of ON-activating the electromagnetic clutch 12 shown in FIG. 6B when the engine rotation rate (ES) exceeds the engine rotation rate set value (N), the fan rotation rate represents a smooth rising property without rapidly shifting to the highest rotation rate as shown by a solid line by repeating ON and OFF of the electromagnetic clutch 12 in plural times, for example, at an interval of 30 msec. Therefore, the loss of the inertia horsepower due to rapid increase of the fan rotation can be reduced and the size of the electromagnetic clutch 12 can be reduced and the life of the electromagnetic clutch 12 can be extended.

Figure 7:
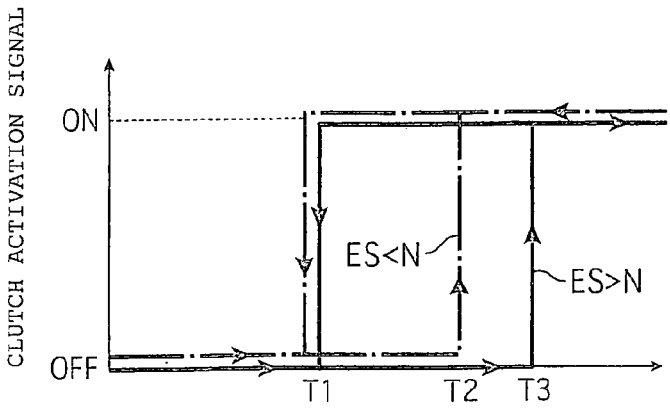
FIG. 7 shows an ON/OFF control method of the clutch by using a radiator cooling fluid temperature (ECT) and an engine rotation rate (ES) according to an example of control of the fan clutch by the control system shown in FIG. 2.

FIG. 7 illustrates a method for ON/OFF controlling a clutch by using the above-described radiator cooling fluid temperature (ECT) and the engine rotation acceleration (ES) as a control parameter of a fan clutch. When the engine rotation acceleration (ES) is below the engine rotation rate set value (N) (ES<N), and when the radiator cooling fluid temperature (ECT) exceeds the clutch activation lower limit temperature T2, the clutch activation signal is changed from OFF to ON and when the ON-activated electromagnetic clutch 12 is below the clutch activation lower limit temperature (T1), the electromagnetic clutch 12 is OFF-activated. However, when the engine rotation acceleration (ES) exceeds the engine rotation rate set value (N) (ES>N), the set value (the clutch activation upper limit temperature) for turning ON the electromagnetic clutch 12 is changed from T2 to T3 (at the high temperature side). By reducing the ON/OFF frequency, the reduction of the fan noise and the control of the inertia horsepower loss are possible and the size of the electromagnetic clutch 12 can be reduced and the life of the electromagnetic clutch 12 can be extended.

The present invention can be applied not only to a magnet type fan clutch for rotatably controlling a cooling fan that is applied to an internal combustion engine for vehicles but also to a general industrial machine for transmitting a torque and a variable torque clutch of a general multipurpose machine or the like.

What is claimed is:

1. A control method of a magnet type fan clutch, wherein a magnet coupling is combined with an electromagnetic clutch; a fan is attached to the magnet coupling side; and the magnet coupling is ON and OFF-controlled by the electromagnetic clutch; the method comprising turning ON and OFF the electromagnetic clutch on the basis of a radiator cooling fluid temperature, an engine oil temperature, a transmission oil temperature, a vehicle speed, an engine rotation rate, an accelerator opening acceleration, a compressor pressure of an air condition and an On or Off signal of the air conditioner, a fuel injection indication amount, a clutch activation lower limit temperature, a clutch activation upper limit temperature, and an engine rotation rate set value to control the fan rotation.

2. The control method of a magnet type fan clutch according to claim 1, wherein the electromagnetic clutch is turned ON and OFF so as to control the fan rotation with the optimum temperature range of the radiator cooling fluid and or the engine oil defined as a control parameter.

3. The control method of a magnet type fan clutch according to claim 1, wherein the engine rotation acceleration or an accelerator opening acceleration that occurs upon acceleration of a vehicle is detected; and when this detected value exceeds a predetermined value, the electromagnetic clutch is turned OFF so as to control the fan rotation.

4. The control method of a magnet type fan clutch according to claim 1, wherein when continuously turning ON the electromagnetic clutch, the electromagnetic clutch is continuously turned ON after repeating ON and OFF of the clutch.

* * * * *